United States Patent [19]

DiStefano

[11] 3,994,040

[45] Nov. 30, 1976

[54] CLEANING DEVICE FOR THE HEAD OF A GOLF CLUB

[76] Inventor: John F. DiStefano, 29224 Firthridge Road, Palos Verdes, Calif. 90274

[22] Filed: June 27, 1975

[21] Appl. No.: 591,027

[52] U.S. Cl. ..... 15/236 R; 15/184; 30/164.9

[51] Int. Cl.[2] ..... A63B 57/00

[58] Field of Search..... 15/104 R, 104 S, 104.01 R, 15/105.5, 142, 184, 186, 197, 236 R; 30/164.8, 164.9, 172; 119/88, 93; 132/103, 121, 143

[56] References Cited

UNITED STATES PATENTS

| | | | |
|---|---|---|---|
| 1,051,715 | 1/1913 | Edwards | 132/143 X |
| 1,166,361 | 12/1915 | Grove | 132/143 |
| 1,183,528 | 5/1916 | Bongiovanni | 15/236 UX |
| 1,507,632 | 9/1924 | Taylor | 15/236 R |
| 2,084,603 | 6/1937 | True | 15/186 X |
| 2,417,585 | 3/1947 | Cahill | 15/145 X |
| 2,420,576 | 5/1947 | Tupper | 132/103 |
| 2,646,804 | 7/1953 | Newman | 132/143 |
| 3,310,879 | 3/1967 | Brzezinski | 15/237 X |
| 3,539,017 | 11/1970 | Johnson | 30/164.8 X |
| 3,566,430 | 3/1971 | Young | 15/236 R |

*Primary Examiner*—Daniel Blum
*Attorney, Agent, or Firm*—Romney Schaap Golant Scillieri Disner & Ashen

[57] ABSTRACT

An apparatus for cleaning the grooves in the head of a golf club, the apparatus comprising a plurality of flexible prongs arranged in a row, the prongs having beveled scraping tips, means for mounting said prongs and a cover portion for fitting over the prongs.

6 Claims, 5 Drawing Figures

CLEANING DEVICE FOR THE HEAD OF A GOLF CLUB

BACKGROUND OF INVENTION

1. Field of the Invention

The present invention relates to a cleaning apparatus and, more particularly, to a device for cleaning the grooves in the head of a golf club, although the invention may be utilized for cleaning the grooves of any device having a plurality of parallel grooves.

2. Description of Prior Art

Several types of golf club heads are designed with parallel grooves spaced across the head of the club. During use of the club these grooves tend to become clogged with dirt, sand and the like and the present invention relates to an apparatus for removing such foreign material from these grooves.

The object of the grooves on a golf club is to provide friction between the face of the club and the ball. The friction enables the golfer to impart maximum energy to the golf ball and produce backspin on the golf ball when desired. Backspin being a desirable result on many golf shots. The creation of the desired friction is best accomplished by having the largest number of grooves possible on the golf club head and having the greatest groove width possible. Thus, all grooved club heads are similar with respect to the groove design present on the club head.

Under the Rules of Golf of the United States Golf Association, the minimum permissable distance between grooves is .075 inch and the maximum permitted width of a groove is 0.035 inch.

The problem of clogged grooves in the head of a golf club has plagued the golfer for years. If the grooves become clogged, there will not be an efficient transfer of energy from the club head to the ball and the ball will not have any backspin. In response to this problem various types of groove cleaning devices have been developed, for example, see U.S. Pat. No. 3,763,515, issued in 1973. However, developing a groove cleaner that works well and can be manufactured and marketed at a reasonable cost has proven to be exceedingly difficult. None of the prior art devices are able to simultaneously clean a plurality of such grooves and accomodate variations in the distances between such grooves.

SUMMARY AND OBJECTS OF INVENTION

The abovementioned problems of the prior art have been overcome by the present invention which fulfills the stated requirements. The present invention is a cleaning device for removing dirt, sand and the like from the head of a golf club, having a plurality of aligned prongs and means for mounting said prongs. There is also provided means for covering said prongs during storage.

A general object of the invention is to provide a golf club cleaning apparatus of the foregoing nature which is an improvement of prior apparatuses.

A primary object of the invention is to provide a golf club cleaner which is simply constructed and economical to produce.

Yet another object of the invention is to provide a cleaning device which is reliable and easy to use.

Still another aspect of the invention is to provide a cleaning device for the head of a golf club which will simultaneously clean a plurality of grooves on a golf club head and which is capable of accomodating variation in the distances between such grooves.

Other objects and advantages of the invention will appear from the following description taken in conjunction with the accompanying drawings.

DESCRIPTION OF THE PREFERRED EMBODIMENTS

Figure 1:
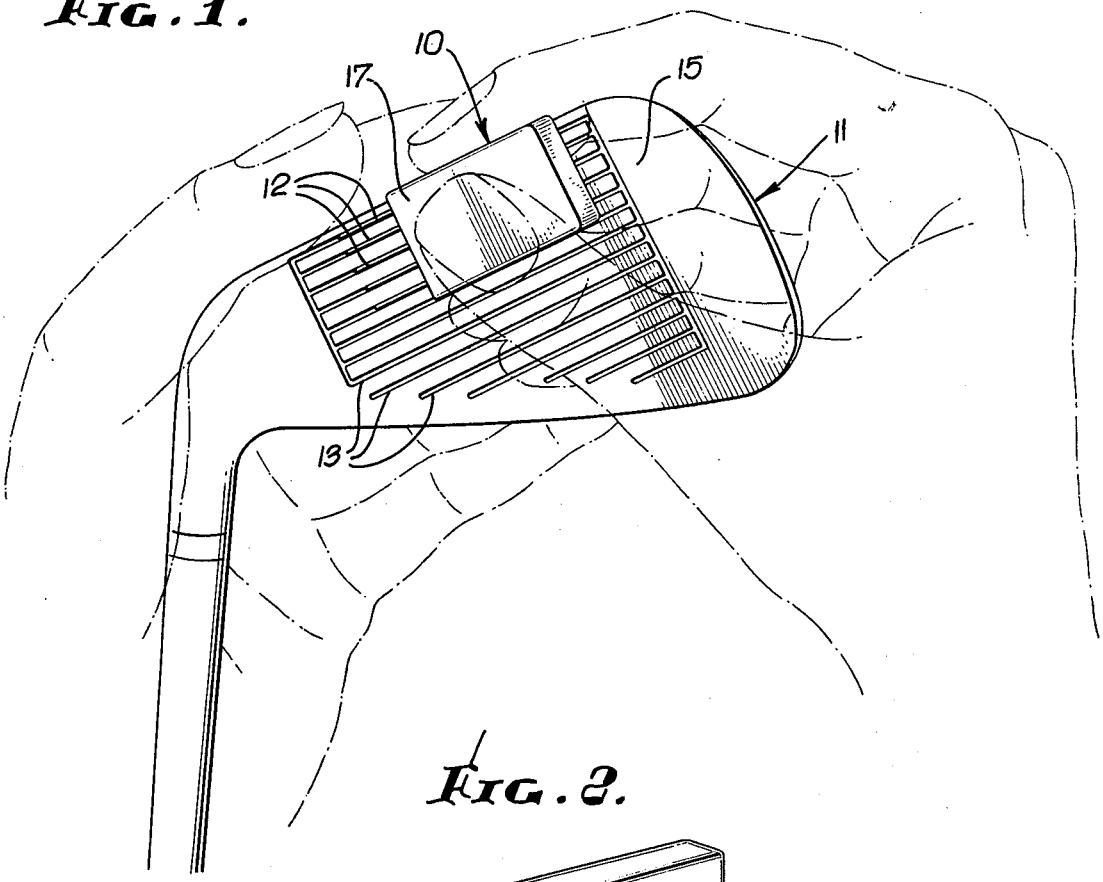
FIG. 1 is an elevational view of the apparatus in use cleaning the head of a golf club.

While the present invention is susceptible to modifications and alternative constructions an illustrative embodiment is shown in the drawings and will be described in detail hereinbelow. It should be understood that it is not the intention to limit the invention to the particular form disclosed; but on the contrary the intention is to cover all modifications, equivalences and alternative constructions falling within the spirit and scope of the invention as expressed in the appended claims.

Referring initially to FIG. 1, there is illustrated a cleaning device, 10, held in the hands of a user as it would be when cleaning the head of a golf club.

Figure 2:
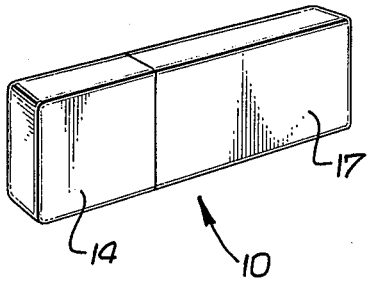
FIG. 2 is a perspective view of the apparatus covered for storage.
Figure 3:
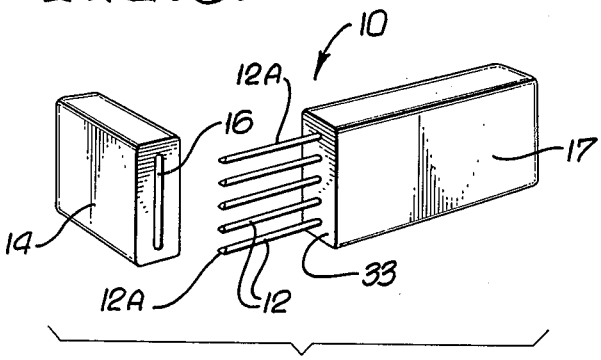
FIG. 3 is a perspective view of the apparatus with the cover off.

An important aspect of the present invention is to provide an apparatus which is simply constructed and therefor economical to produce, and which is reliable and easy to use. Referring to FIGS. 2 and 3, the apparatus 10 is shown with a protective cover 14.

The apparatus includes a support structure 17, into which are positioned five aligned prongs 12. The prongs at each end of the alignment are end prongs 12A. The prongs 12 are of equal length. The support structure 17 is in the shape of a rectangular parallelepiped. Because the support structure 17 is grasped by the human hand during use, the preferred dimensions of the support structure 17 are $1.50 \times 0.150 \times 0.625$ inch. In this preferred size, the prongs 12 are embedded in the surface having dimensions $0.150 \times 0.625$ inch.

The prongs 12 are of sufficient flexibility so as to accommodate any variations in the spacing between the grooves in a golf club head. Applicant has found that a suitable material for the prongs 12 of the apparatus 10 is 0.029 gauge piano or music wire. When such wire is used and the prongs are exposed 0.875 inch and spaced 0.105 inch apart, center to center, sufficient flexibility is present so as to accommodate variation in the distances between such grooves.

While in the closed configuration, illustrated in FIG. 2, the prongs 12 of the apparatus 10 are protected from accidental damage.

FIG. 3 illustrates the device and cover in the open state. The cover 14 comprises a solid material such as plastic, wood, or the like, wherein an opening 16 is present to accommodate the corresponding prongs 12. The opening 16 is of sufficient depth so as to accommodate the entire length of the prongs 12. In order that the cover 14 may be retained over the prongs 12 there is a friction fit between the end prongs 12A and the inner wall of the opening 16. In the closed state, the inner wall of the opening 16 abutting the end prongs 12A produces a friction fit. However, the opening 16 is sufficiently large so that there is no permanent deformation of the end prongs 12A. In the preferred embodiment, the opening 16 is located so that the cover 14 and support structure 17 are flush and adjoining.

While no specific shape or dimension of the cover 14 is required except that the structure be of sufficient size so as to accommodate the prongs 12 applicant has found that a cover in the shape of a rectangular parallelepiped having dimensions of 1 × 0.150 × 0.625 inch and having an opening 16 located in the surface having dimensions 0.625 × 0.150 inch is preferable. With these dimensions, a depth of the opening 16 of 0.906 inch is adequate to accommodate the prongs 12 having the preferred composition and length of 0.875 inch.

Figure 4:
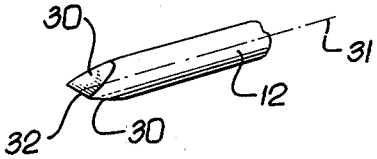
FIG. 4 is an enlarged perspective view of the tip of one of the pins of the apparatus.

Referring now to FIG. 4, illustrated therein is an enlarged view of the tip of a prong 12. The tip of the prong 12 is chisel ground so that two ground surfaces 30 are formed. There is formed at the intersection of the ground surfaces 30 an included angle. While there is no particular size to the angle required except that is be a size sufficient to enable the end of the edge 32 to abut the bottom of the groove 13 in the surface 15 of the golf club head 11, the inventor has found that the preferred included angle is 90° with each grooved surface 30 forming an included 45° angle with the centerline 31 of the prong 12. The prongs 12 are positioned so that the edge 32 formed by the intersection of the ground surfaces 30 is parallel to the corresponding edge of every other prong of the cleaning device 10. The prongs 12 are also aligned so that the edges 32 are not parallel to the straight line defined by the points at which the prongs 12 intersect the surface 33 of the support structure 17. While it is only necessary that the edges 32 not be parallel to said defined straight line, the inventor has found that the preferred embodiment of the invention is to align the edge 32 of each prong 12 so that it is perpendicular to said defined straight line.

Referring now to FIG. 1, illustrated therein is a golf club head 11 having a surface 15 in which are uniformly spaced parallel grooves 13. As mentioned previously it is not unusual for the grooves 13 to become imbedded with dirt, sand or the like when the golf club is used. The apparatus 10 is used by fitting the tips of the prongs 12 into the grooves 13 in the surface 15 of the golf club head 11. The apparatus 17 is then moved in the direction of the grooves 13. As the apparatus 10 is moved across the surface 15 of the golf club head 11 the tips of the prongs 12 will remain in the grooves 13 and force all foreign matter out of the grooves 13.

Figure 5:
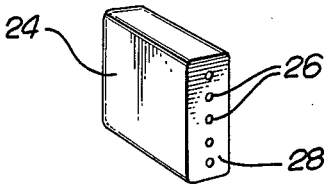
FIG. 5 is a perspective view of a cover for the apparatus.

Referring now to FIG. 5, there is illustrated another embodiment of the cover of the apparatus 17. The cover 24 is similar in size and shape to the cover 14. The difference between the two structures lies in the fact that cover 24 has a plurality of openings 26 in place of the single opening 16. The openings 26 on surface 28 are of sufficient length so as to accommodate the entire length of the prongs 12 and are located so that the cover 24 and support structure 17 are flush and adjoining. If the openings 26 have a diameter of 0.030 inch and a depth of 0.906 inch, the inventor has found that the prongs 12 having the preferred embodiment are protected and the cover 24 is retained about the prongs 12 by friction between the outer surface of the prongs 12 and the inner surfaces of the openings 26 during storage. The cover 24 may also be used to repair any permanent distortions to the prongs 12. By merely placing the cover 24 over the prongs 12 of the apparatus 10, any kinks or bends in the prongs 12 will be removed when the prongs 12 are forced to take the shape of the openings 26.

Clearly what has been shown is an improved cleaning device for the head of a golf club which is very simply constructed, which has few parts, which may be easily used, and which is marketable at a very resonable cost.

I claim as my invention:

1. A cleaning device for the head of a golf club, comprising:

a handle member having a forward surface;

a plurality of flexible rod-like prongs having rearward ends attached to the forward surface of said handle member and beveled forward cleaning ends having straight scraping edges, said forward cleaning ends aligned in a row and displaced from the forward surface of said handle member a distance sufficient to allow lateral movement between said cleaning ends to enable said cleaning ends to accommodate variable spaced golf head grooves and said scraping edges being disposed generally perpendicular to said row of cleaning ends; and a cap having an inner cavity of sufficient depth for receiving the entire length of said prongs and having a rearward surface for abutting the forward surface of said handle member with a portion of said inner cavity frictionally engageable with at least one of said prongs for removably securing said cap to said handle member when the device is not in use.

2. The device of claim 1, wherein said handle member is in the shape of a rectangular parallelepiped, said forward surface having a width less than one fourth the length and haivng a longitudinal axis normal to said forward surface and said rectangular prallelepiped having the greatest dimension in the direction of said longitudinal axis.

3. The device of claim 1, wherein said prongs are disposed generally parallel and the distance between adjacent prongs is approximately 0.1 inch.

4. The device of claim 3 wherein the prongs are at least 0.5 inch in length and are composed of 0.029 gauge piano wire.

5. The device of claim 1 wherein said cap is in the shape of a rectangular parallelepiped and the longitudinal axis of said cavity is generally parallel to the longest dimension of said cap and said cap and handle member are flush and adjoining when said cap is secured to said handle member.

6. The device of claim 1, wherein said handle member is in the shape of a rectangular parallelepiped of dimensions approximately 1 inch × 0.625 inch × 0.150 inch and said forward surface has dimensions approximately 0.625 inch × 0.150 inch so that the device may be easily held in the user's hand between the thumb, forefinger and index finger, and said prongs are generally parallel and the distance between adjacent prongs is approximately 0.1 inch, said prongs being at least 0.5 inch in length and composed of 0.029 gauge piano wire, and said cap is a rectangular parallelepiped having said cavity centrally located in a surface having dimensions approximately 0.625 inch × 0.150 inch so that said cap member and said handle member are flush and adjoining when said cap is secured to said handle member and the longest dimension of said cap is approximately 1 inch.

* * * * *